United States Patent [19]

Take

[11] Patent Number: 4,801,117

[45] Date of Patent: Jan. 31, 1989

[54] PORTABLE SUPPORT BOOM FOR WINDOW WASHER

[75] Inventor: Rafael C. Take, Aurora, Colo.

[73] Assignee: Building Access Products, Inc., Aurora, Colo.

[21] Appl. No.: 147,717

[22] Filed: Jan. 25, 1988

[51] Int. Cl.[4] ..... E04G 3/10; E04G 5/04

[52] U.S. Cl. ..... 248/237; 182/63; 182/142; 182/150; 212/195; 212/266

[58] Field of Search ..... 182/142, 150, 63, 12; 212/195, 266; 248/237

[56] References Cited

U.S. PATENT DOCUMENTS

| | | | |
|---|---|---|---|
| 2,569,821 | 10/1951 | Maxeiner | 248/237 |
| 3,608,670 | 9/1971 | Blake | 182/142 |
| 3,854,550 | 12/1974 | Shingler | 182/142 |
| 4,130,179 | 12/1978 | Williams | 182/142 |
| 4,234,055 | 11/1980 | Beeche | 182/142 |
| 4,274,507 | 6/1981 | Williams | 182/142 |
| 4,296,905 | 10/1981 | Powell | 248/237 |
| 4,454,928 | 6/1984 | Marteau | 182/142 |
| 4,496,027 | 1/1985 | Fisher | 248/237 |
| 4,545,558 | 10/1985 | Crudele | 182/142 |

OTHER PUBLICATIONS

Photocopies of Disclosure in Application, p. 1, lines 19–34.

Advertisement for Fitch Enterprises Regarding "The Mule" Disclosed in Application, p. 1, lines 35–37; p. 2 lines 1–7.

*Primary Examiner*—Reinaldo P. Machado

*Attorney, Agent, or Firm*—Fields, Lewis, Pittenger & Rost

[57] ABSTRACT

A portable support boom for window washers is provided on a support frame which has extendable boom sections that can be folded into a collapsed position and includes transporting wheels and handles so that the boom can be manually rolled from one place to another. When at the work site, the boom sections can be unfolded, then can be used either in extended or retracted position. A support frame attaches to the folded booms when in collapsed position and can be erected to form a triangular configuration for supporting extending end of the boom when in the work position. Support wheels are provided on the support frame for moving the boom laterally between different work positions at the same work site. A brake can be provided to releasably lock the support wheels at each work position. Also, the support frame can be selectively pivoted at each work position to bring the transporting wheels into contact with the supporting surface to inhibit lateral movement of the boom during use. Upon completion of the job, the boom can easily be dissembled into a collapsed position for wheeling by one person to another location.

15 Claims, 4 Drawing Sheets

PORTABLE SUPPORT BOOM FOR WINDOW WASHER

TECHNICAL FIELD

This invention relates to a portable support boom for supporting a load and more particularly to one which is particularly adaptable for window washer in which extensible boom sections are folded into a collapsed configuration and has a pair of support wheels and handles so that the boom can manually be rolled from one place to another, such as from a vehicle to the job site and back again.

BACKGROUND ART

Many attempts have been made to construct a portable support boom for window washers. However, while all of these have accomplished their intended purpose, they inherently had one or more deficiencies.

For example, one prior art boom includes a triangular base which is placed on the roof adjacent the edge and has an apex by which the boom is supported as it extends out over the side of the building. At the inner end of the boom, which rests on the roof is a transverse support in which concrete blocks or other weights can be placed for acting as a counterweight for the boom. The boom is not easily transportable from one location to the other but must be carried in several pieces. Also, as the window washer works across the building, periodically he must come up and dissemble the boom and move it laterally across the building to the next location and reassemble it. Thus, the labor involved is substantial and the time actually spent cleaning windows is substantially minimized because of the repetitive assembly and disassembly time required.

Another portable boom, is sold by Fitch Enterprises of Council Bluffs, Iowa. It is sold under the trademark "The Mule". This device has a beam supported between two pairs of spaced wheel supports so that it can be laterally moved along the roof surface. The wheels may be provided with different length legs for different roof structures. Also, an extension beam can be utilized. However, all of these parts are separate and must be carried to the job location separately from the main beam and wheels.

DISCLOSURE OF THE INVENTION

In accordance with this invention, a portable support boom is provided which can be configured in a collapsed position for wheeling by one person to and from a work site and can be reconfigured at the work site into a working position for supporting a load on an extended end thereof. The boom includes a generally rectangular support base with opposite ends and sides and having a first pair of transporting wheels journaled on opposite ends of the base for rolling the base with the boom in collapsed position to and from a work site. A second pair of positioning wheels are journaled on one side of the base for moving the boom from one work position to another work position at the work site. A first boom section has a first end pivotly mounted centrally on the support base and a second end extending over the other side of the support base. A first locking pin for releasably locking the first boom section in fixed position on the support base when the boom is in collapsed position is provided. A second boom section has a first end pivoted to the second end of the first boom section for folding into juxtaposed relationship with the upper surface of the first boom section when the support boom is in the collapsed position. The second boom section also is pivotal to a working position as an extension of the first boom section, the second boom section having a second end with means for supporting a load. A second locking pin releasably locks the second boom section in the juxtaposed position with respect to the first boom section. A third locking pin releasably locks the second boom section in the working position with respect to the first boom section. A support device for supporting the boom adjacent the second end of the second boom section includes an elongated support frame having first and second ends. Wheels are journaled at each end of the frame for moving the frame longitudinally in cooperation with the positioning wheels of the support base to move the boom from one work position to another. A pair of support arms have first and second ends wherein the first end of one of the support arms is pivoted to the first end of the support frame and the first end of the other support arm is pivoted to the second end of the support frame. The arms are foldable against the support frame when in collapsed position and means is provided for holding the second ends of the support arms against each other when the support arms are pivoted upwardly from the support frame to a raised position so that the support arms and the support frame form a triangular configuration. Means is also provided for connecting the second ends of the support arms to the second boom section when the support boom is in the working position.

In a specific configuration, the support frame can include upwardly extending flanges along each side edge wherein the support arms lie side by side within the flanges. The releasable attaching means can include a fourth locking pin which also connects the second ends of the support arms together when the support arms are in raised position. The support frame may be provided with spaced wells therein for receiving removable counterweights configured to fit in the wells and counterbalance a load on the supporting means of the second boom section.

The removable attaching means can also include a pair of handles connected to the second boom section having outwardly extending portions for use in wheeling the support boom from one location to another. A pair of laterally spaced hooks on the support frame are engageable with the handles to support one end of the support frame. A fifth locking pin releasably attaches the other end of the support frame to the second boom section. A pair of stabilizing rods can be connected between the support arms and second boom section when the boom is in working position to give more stability to the device.

The first boom section can comprise first and second telescopic members. The fifth locking pin also can releasably secure the telescopic members in either a contracted position or an extended position for use in different work site environments. The releasable attaching means can further include a first socket means attached to the second boom section for receiving the second ends of the support arms when the telescopic members are in contracted position and a second socket means spaced from the first socket means and attached to the second boom section for receiving the second ends of the support arms when the telescopic members are in the extended position. The first socket means is located closer to the second end of the second boom section than the second socket means and is mounted at a more acute angle to the second boom section than the second socket means.

From the foregoing description, it can be seen that a portable boom has been provided which easily can be transported by one person from one location to another and which easily can be erected at the site by the same person with a minimal amount of time and effort being required.

Additional advantages of this invention will become apparent from the description which follows, taken in conjunction with the accompanying drawings.

BEST MODE FOR CARRYING OUT THE INVENTION

In accordance with this invention, a support boom B for supporting a variety of load is provided. This boom B has particular application for use by window washers wherein the boom is placed on the roof of a building and the window washer is supported on a suitable tether or cable attached to the end of the boom which overhangs the side of the building. However, it will be understood that the boom could be used for a variety of load supporting tasks and is not limited to use by window washers.

Figure 1:
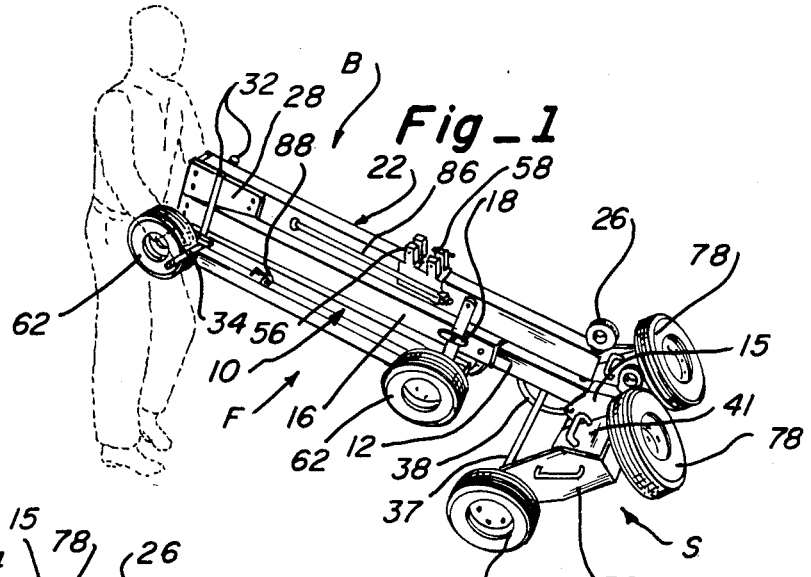
FIG. 1 is perspective view of the portable support boom of this invention being wheeled from one location to another.
Figure 2:
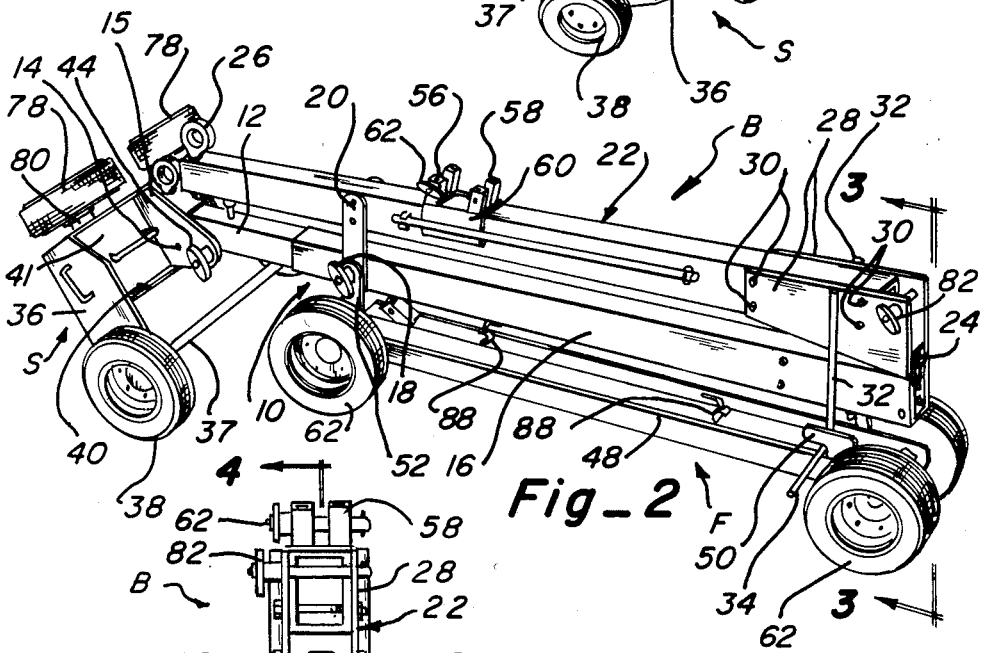
FIG. 2 is a perspective view of the portable support booms of FIG. 1 in resting collapsed position.
Figure 3:
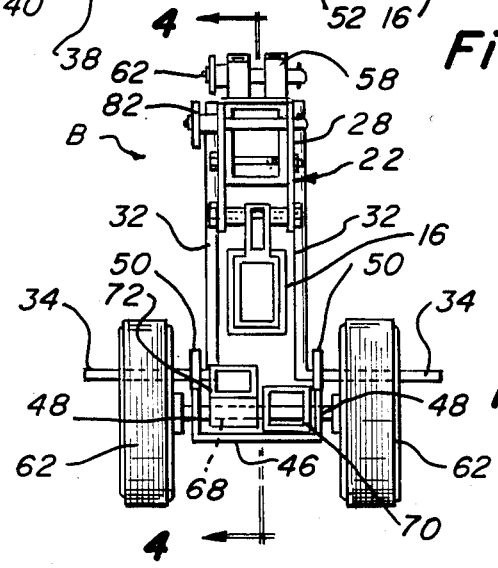
FIG. 3 is an enlarged end view, taken along line 3—3 of FIG. 2.

The support boom comprises a first boom section 10 having a first telescopic member 12, which is attached to support base S by means of a pivot pin 14 extending between spaced flanges 15, and a second telescopic member 16 which is slidably mounted on first telescopic member 12 and held in fixed position by lock pin 18. As will be apparent from FIG. 2, the lock pin extends between the arms of a U-shape bracket 20 which is attached to a second boom section 22 which is pivoted to the outer end of telescopic member 16 by means of a hinge 24. In the collapsed position shown, second boom section 22 overlays first boom section 10 in juxtaposed relationship for storage and transporting from one location to another. The end of second boom section 22 is provided with an eye 26 for supporting a load, as will be explained more fully below. A pair of side plates 28, associated with hinge 4 are attached to opposite sides of second boom section 22 as by bolts 30. A depending arm 32 extends from each side plate 28, as shown and terminates in an outwardly extending handle 34 which can be grasped by a workman, as shown in FIG. 1 for transporting the boom B from one location to another.

Support base S is generally rectangular in shape and has a base plate 35 with a pair of opposite side walls 36 extending upwardly therefrom through which an axle 37 extends for journaling transporting wheels 38. Side walls 36 are joined by lateral upstanding flanges 39. Thus, the configuration to side walls 36, supporting flanges 15 and upstanding flanges 39 form wells 40 for receiving counterweights 41. The purpose of the counterweights is more fully discussed below. The upper end of the inner edge of telescopic member 12 engages the edge of a locking flange 42, best seen in FIG. 4, which extends between support flanges 15 and is held thereagainst by lock pin 44. Thus, when the workman picks up the end of boom B by handle 34 from the position shown in FIG. 2 to the position shown in FIG. 1, the support frame pivots together with the boom as a unit about axle 37.

Figure 7:
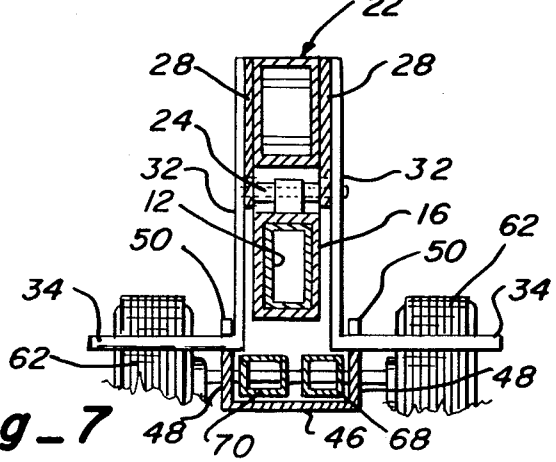
FIG. 7 is a fragmentary, enlarged, vertical section, taken along line 7—7 of FIG. 4, showing details of the support frame and the boom sections and the innerconnection therebetween.
Figure 5:
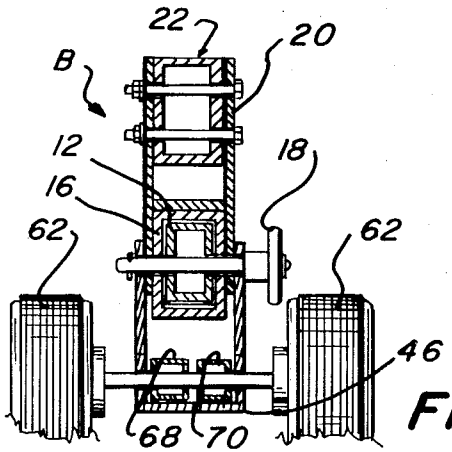
FIG. 5 is a fragmentary vertical section, taken along line 5—5 of FIG. 4, on an enlarged scale, showing details of locking pins holding the boom sections in fixed collapsed position.

When the boom is in this collapsed position, the support frame F is supported on the underside of first boom section 10. In this regard, support frame F is in the form of a channel 46 having upwardly extending spaced side edges 48, as best seen in FIG. 7. Attached to one end of each side edge 48 is an ear 50, each of which hooks over the top of one of handles 34 for releasably attaching the support frame at that end to first boom section 10. The other end of support frame F is provided with a pair of up-standing ears 52 each having an aperture through which lock pin 18 extends. Thus, lock pin 18 serves a dual function of holding the telescopic members 12 and 16 in retracted position and holding the end of support frame F in attached relationship thereto.

Figure 4:
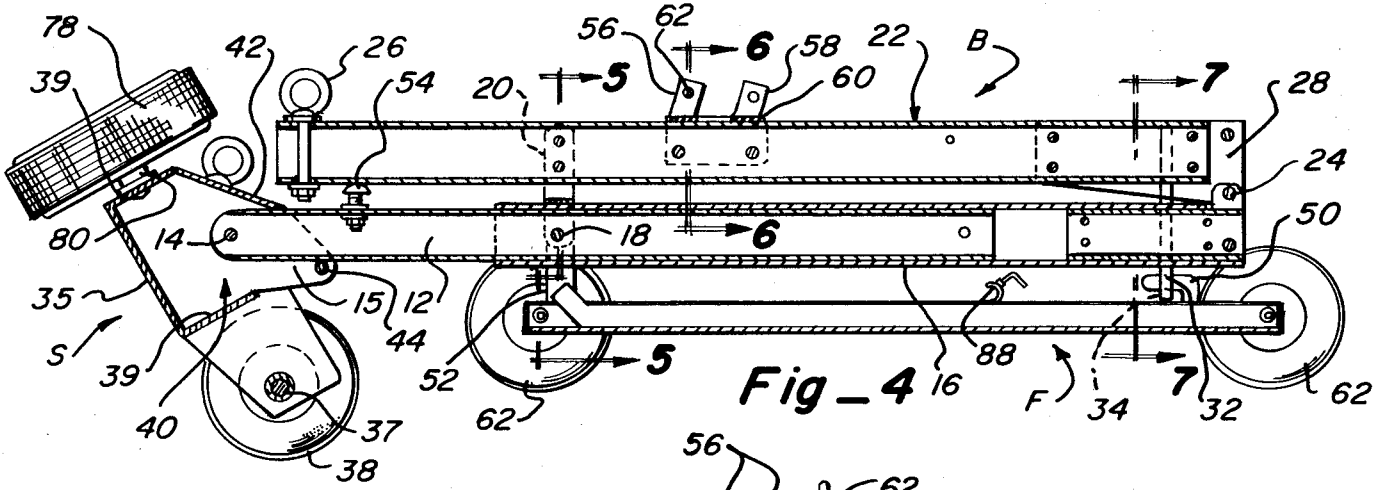
FIG. 4 is a vertical section, taken along line 4—4, of FIG. 3, on a slightly reduced scale of the support boom.
Figure 6:
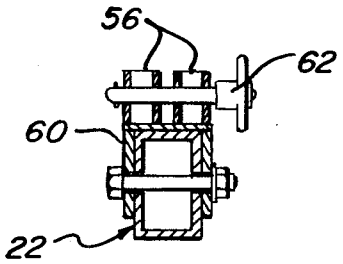
FIG. 6 is an enlarged vertical section, taken along line 6—6 of FIG. 4, showing the sockets for receiving the support frame.
Figures 8, 9, 10, 11, 12:
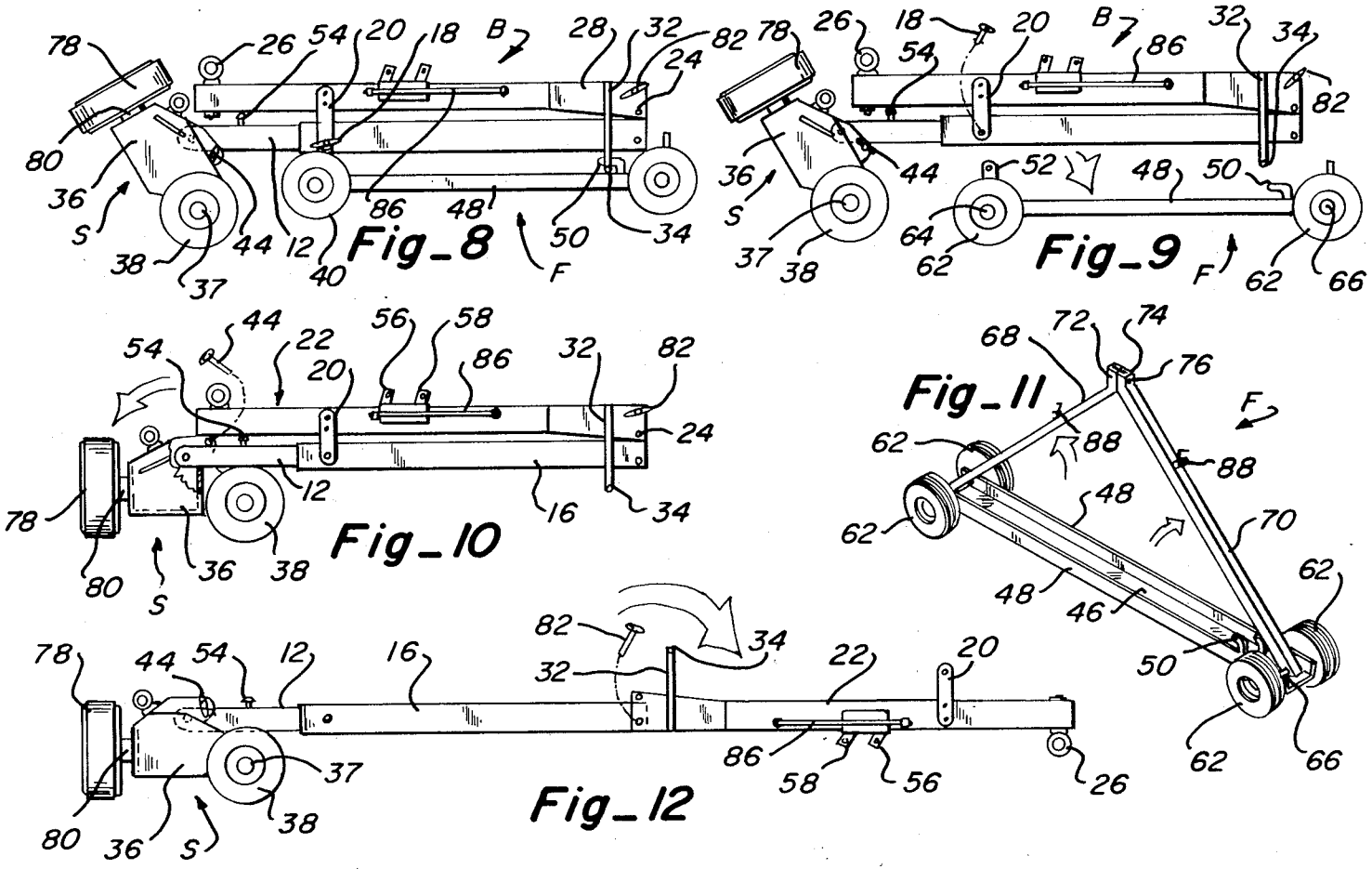
FIG. 8 is side elevation on a smaller scale, of the portable boom in collapsed position.
FIG. 9 is a side elevation, similar to FIG. 8 but showing the support frame removed.
FIG. 10 is a side elevation similar to FIGS. 8 and 9 showing the support base in lowered position.
FIG. 11 is a perspective view of the support frame in raised position.
FIG. 12 is a side elevation of the support boom with the support boom sections in open working position.

When the boom B is in the collapsed position shown in FIG. 4, the forward end of second boom section 22 is supported on a stop 54 attached adjacent the inner end of first telescopic member 12. Spaced inwardly from eye 26 are a first pair of laterally spaced sockets 56 and a second pair of laterally spaced sockets 58 formed integrally with a bracket 60. These sockets are for supporting the boom in retracted and extended position, respectively, as will be described below. As best seen in FIG. 8, a lock pin 62 is provided which can be releasably inserted through transverse openings in either sockets 56 or 58.

The operation of the portable boom will now be explained. After the boom has been wheeled to the work site in the manner illustrated in FIG. 1, it is laid down in the position shown in FIG. 8. Thereupon, pin 18 is withdrawn so that support frame F can be pushed to the right, as viewed in FIG. 9 so that hooks 50 are released from handles 34 and the support frame is then supported on the ground by wheels 62 journaled at either end of channel 46 on axles 64 and 66, as shown. Conveniently, a pair of support arms 68 and 70, which were folded between flanges 48 of channel 46 each have one end journaled respectively, to axle 64 and 66 so that they can be pivoted upwardly to the position shown in FIG. 11, whereupon their upturned ends 72 and 74, respectively, come into confronting relationship. These ends have a transverse opening, such as opening 76 for receiving lock pin 62, as will be described below.

Next, lock pin 44 is retracted which allows support base S to pivot from the position shown in FIG. 8 to the position shown in FIG. 10, bringing spaced positioning wheels 78 into contact with the ground. These wheels are journaled to the support base S by means of axles, such as axle 80. Flange 48 is then reinserted above first telescopic member 12 to lock the support frame in a second fixed position relative to the boom sections.

Now that lock pin 18 has been removed to separate support frame F from the rest of the boom structure, lock pin 82, which extends through flanges 28 adjacent hinge 24, can be removed and second boom section 22 can be pivoted from the position shown in FIG. 10 to that shown in FIG. 12. Then lock pin 82 can be reinserted to hold the booms in fixed longitudinal relationship with respect to each other. If the boom is to be extended, telescopic members 12 and 16 can be slid longitudinally with respect to each other to the position shown in FIG. 13 whereupon lock pin 18 can be reinserted to hold the telescopic members in extended position. Also, the boom can be raised and the ends 72 and 74 of support arms 68 and 70 of the support frame can be inserted in laterally spaced sockets 58 and held in place by lock pin 62. Conveniently, the dimensions of support arms 68 and 70 are such that the raising of the booms raises wheels 38 of support base S off of the surface so that the entire boom structure is now supported by wheels 78 and 62 so that it can be moved laterally across a roof or other supporting structure. Conveniently, a brake 84, shown in FIG. 13 can be provided for locking the wheels at a desired work location so that the boom structure will not roll during use. Furthermore, pin 44 can be withdrawn to permit support frame S to rotate in a clockwise direction, as shown by arrow 85 so that transporting wheels 38 engage the supporting surface to further inhibit lateral movement of boom B at the work position. To move to the next work position, the brake is released and support frame S is pivoted in a counterclockwise direction to raise transporting wheels 38 to the position in FIGS. 13 and 14 and lock pin 44 is reinserted.

Figure 13:
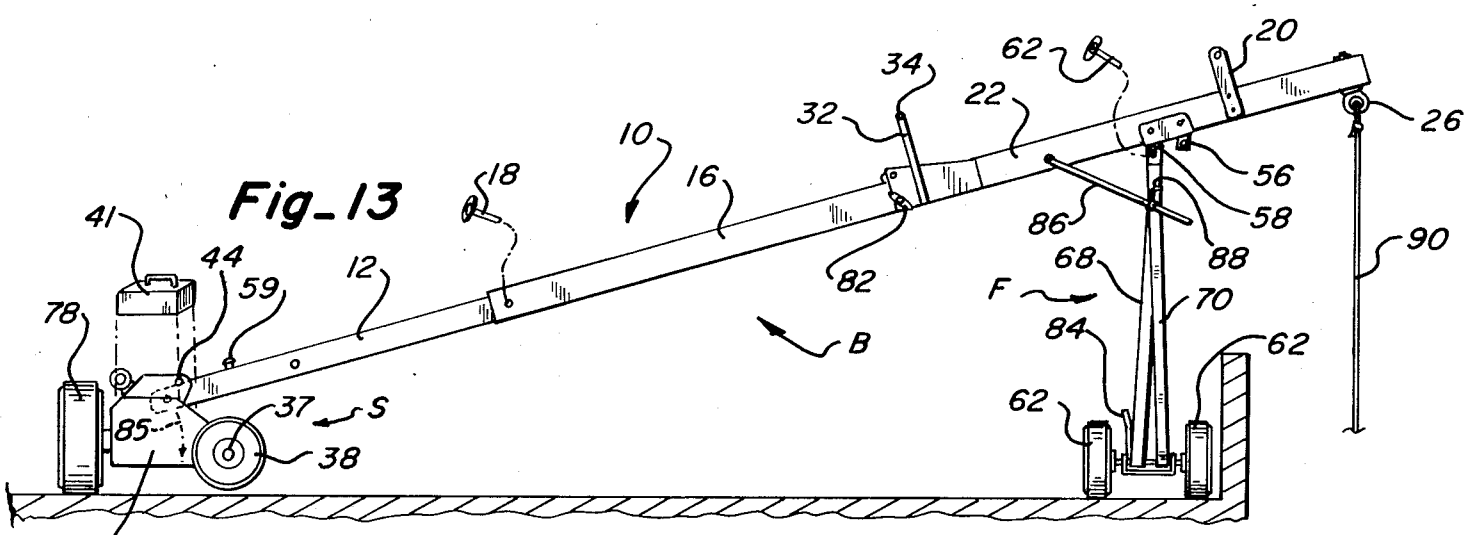
FIG. 13 is a side elevation of the support boom in extended working position.
Figure 14:
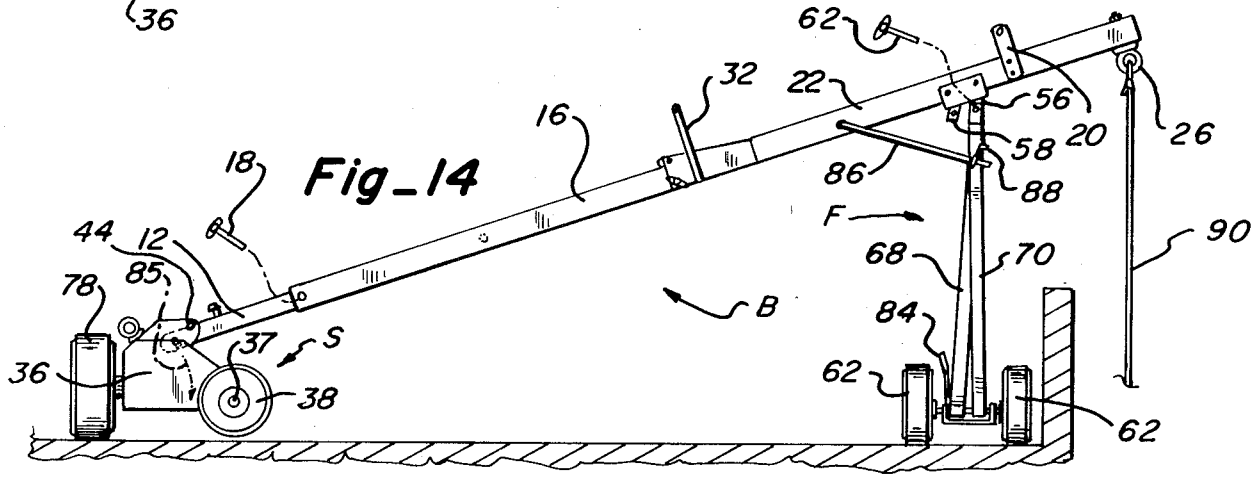
FIG. 14 is a side elevation of the support boom in working retracted position.

Conveniently, a pair of stabilizer struts 86 have one end pivoted to second boom section 22 and the other end is receivable in a clamp 88 on respective support arms 68 and 70. When in an erected position, as shown in FIG. 13, a load can be supported on a tether or rope 90 attached to eye 26. Because of the long extension of the boom and the provision of one or more counterweights 41 supported in wells 40 very heavy loads can be supported safely. For lighter loads or on buildings where the long extension is not possible, the telescopic members 12 and 16 can be moved back to the contracted position shown in FIG. 14. When in this position, the support frame is then moved to socket 56 which is at a greater angle to second boom extension 22 than is socket 58 to accommodate the steeper angle of the boom and to partially compensate for the shorter length of the boom by putting the support point closer to eye 26.

From the foregoing, the advantages of this invention are readily apparent. A portable boom B has been provided which can be collapsed into a relatively small size for wheeling around by one person to a work site. The boom can easily be erected by one person for use. Such erection being done very quickly by the removal and manipulation of certain lock pins, all as previously described. The boom can be used in either a contracted or extended position depending upon the load to be supported and the physical space available at the work site. By pivoting the support frame when at the work position the transporting wheels, together with the brake, inhibit lateral movement. After the work is completed, the boom can be disassembled in the reverse order to that previously described so as to be removed from the work site and taken to another location.

This invention has been described in detail with reference to a particular embodiment thereof, but it will be understood that various other modifications can be effected within the spirit and scope of this invention.

I claim:

1. A portable support boom which can be configured in a collapsed position for wheeling by one person to and from a work site and can be reconfigured at the work site into a working position for supporting a load on an extending end thereof, said support boom comprising:

a generally rectangular support frame with opposite ends and sides and having a first pair of transporting wheels journaled on opposite ends of said base for rolling said base with said boom in collapsed position to and from a work site and a second pair of positioning wheels journaled on one side of said base for moving said boom from one work position to another work position at the work side;

a first boom section, having a first end pivotally mounted centrally on said support base and a second end extending over the other side of said support base;

a first lock pin for releasably locking said first boom section in fixed position on said support base when said boom is in said collapsed position;

a second boom section, having a first end pivoted to said second end of said first boom section for folding into juxtaposed relationship with the upper surface of said first boom section when said support boom is in said collapsed position, said second boom section also being pivotable to a working position as an extension of said first boom section, said second boom section having a second end with means for supporting a load;

a second lock pin for releasably locking said second boom section in said juxtaposed position with respect to said first boom section;

a third lock pin for releasably locking said second boom section in said working position with respect to said first boom section;

a support device for supporting said boom adjacent said second end of said second boom section, including an elongated support frame having first and second ends, wheels journaled at each end of said frame for moving said frame longitudinally in cooperation with said positioning wheels of said support base to move said boom from one work position to another, a pair of support arms having first and second ends, said first end of one of said support arms being pivoted to said first end of said support frame and said first end of the other of said support arms being pivoted to said second end of said support frame, said arms being foldable against said support frame when in said collapsed position, means for holding said second ends of said support arms against each other when said support arms are pivoted upwardly from said support frame to a raised position so that said support arms and said support frame form a triangular configuration; and means for connecting said second ends of said support arms to said second boom section when said support boom is in said working position.

2. A portable support boom, as claimed in claim 1, further including:

means for releasably attaching said support frame to the underside of said first boom section when said boom is in said collapsed position.

3. A portable support boom, as claimed in claim 2, wherein:

said releasable attaching means includes a fourth lock pin which also connects said second ends of said support arms together when said support arms are in raised position.

4. A portable support boom, as claimed in claim 1, wherein:

said support device includes an upwardly extending flange along each side edge; and said support arms lay side by side within said flanges when in said collapsed position.

5. A portable support boom, as claimed in claim 1, wherein:

said support frame has spaced wells therein; and removable counterweights configured to fit in said wells and counterbalance a load on said supporting means of said second boom section.

6. A portable support boom, as claimed in claim 2, wherein said releasably attaching means includes:

a pair of handles connected to said second boom section having outwardly extending portions for use in wheeling said support boom from one location to another;

a pair of laterally spaced hooks on said support frame engageable with said handles to support one end of said support frame when in said collapsed position; and a fifth lock pin for releasably attaching the other end of said support frame to said second boom section.

7. A portable support boom, as claimed in claim 6, wherein:

said first boom section comprises first and second telescopic members; and said fifth lock pin releasably secures said telescopic members either in a contracted position or in an extended position.

8. A portable support boom, as claimed in claim 7, wherein said releasable attaching means further includes:

a first socket means attached to said second boom section for receiving said second ends of said support arms when said telescopic members are in said contracted position; and a second socket means spaced from said first socket means and attached to said second boom section for receiving said second ends of said support arms when said telescopic members are in said extended position.

9. A portable support boom, as claimed in claim 8, wherein:

said first socket means is located closer to said second end of said second boom section than said second socket means.

10. A portable support boom, as claimed in claim 8, wherein:

said first socket means is mounted at a more acute angle to said second boom section than said second socket means.

11. A portable support boom, as claimed in claim 1, further including:

a pair of stabilizer rods connectable between said support arms and said second boom section when said boom is in said working position.

12. A portable support booms, as claimed in claim 1, wherein:

said support frame holds said boom sections at a sufficiently high elevation to lift said transporting wheels off of the support surface so that said support boom can roll laterally on said positioning wheels and said support frame wheels.

13. A portable support boom, as claimed in claim 12, further including:

releasable brake means connected to said positioning wheels for selectively locking said positioning wheels when said support boom is in a desired work position at the work site.

14. A portable support boom, as claimed in claim 12, further including:

means to selectively bring said transporting wheels into contact with the supporting surface to inhibit lateral movement of said boom at each work location.

15. A portable support boom, as claimed in claim 14, wherein:

said means includes said first lock pin.

* * * * *